US006254223B1

(12) United States Patent
Kim et al.

(10) Patent No.: US 6,254,223 B1
(45) Date of Patent: Jul. 3, 2001

(54) INK JET PRINTER HEAD ACTUATOR AND MANUFACTURING METHOD THEREOF

(75) Inventors: Il Kim, Suwon; Jae Woo Joung, Inchon; Young Seuck Yoo, Seoul, all of (KR)

(73) Assignee: Samsung Electro-Mechanics Co., LTD, Kyungki-Do (KR)

( * ) Notice: Subject to any disclaimer, the term of this patent is extended or adjusted under 35 U.S.C. 154(b) by 0 days.

(21) Appl. No.: 09/336,662

(22) Filed: Jun. 18, 1999

(30) Foreign Application Priority Data

Oct. 21, 1998 (KR) ..... 98-44070

(51) Int. Cl.[7] ..... B41J 2/045
(52) U.S. Cl. ..... 347/70
(58) Field of Search ..... 347/68, 70, 71, 347/72

(56) References Cited

U.S. PATENT DOCUMENTS 4,730,197 * 3/1988 Raman et al. ..... 347/70
5,933,167 * 8/1999 Shimada et al. ..... 347/70
6,086,188 * 7/2000 Ishida et al. ..... 347/70

* cited by examiner

*Primary Examiner*—Benjamin R. Fuller
*Assistant Examiner*—C Dickens
(74) *Attorney, Agent, or Firm*—Darby & Darby

(57) ABSTRACT

Disclosed is an ink jet printer head actuator and a manufacturing method thereof. The ink jet printer head actuator comprises a vibrating plate, a portion of a plate surface of the vibrating plate being mechanically deformed by an external force; a chamber plate formed with a plurality of chambers, the chamber plate sucking and discharging ink into and out of the plurality of chambers by vibration of the vibrating plate; a protective thin film intervened between the vibrating plate and the chamber plate for preventing the vibrating plate from being etched when the plurality of chambers are formed in the chamber plate and for preventing the vibrating plate from being corroded by keeping ink in the plurality of chambers from being brought into contact with the vibrating plate; a plurality of piezoelectric elements attached to a surface of the vibrating plate for vibrating portions of the vibrating plate which correspond to the plurality of chambers, respectively, while being deformed in a lengthwise direction depending upon electric power supply; and a plurality of electrodes at least laminated on the plurality of piezoelectric elements for supplying electric power thereto, respectively.

2 Claims, 7 Drawing Sheets

INK JET PRINTER HEAD ACTUATOR AND MANUFACTURING METHOD THEREOF

BACKGROUND OF THE INVENTION

1. Field of the Invention

The present invention relates to an ink jet printer head actuator and a manufacturing method thereof, and more particularly, the present invention relates to an ink jet printer head actuator and a manufacturing method thereof, in which a protective thin film serving as an etching ceasing layer is integrally deposited between a vibrating plate and a chamber plate made of thin metal plates, whereby formation of a plurality of chambers by etching in the chamber plate is performed in a more precise and economical manner, and the vibrating plate is prevented from being corroded due to direct contact with ink, whereby mechanical rigidity of a printer head is improved.

2. Description of the Related Art

Generally, ink firing scheme in an ink jet printer head is largely divided into a thermal bubble jet type ink firing scheme and a piezo transducer type ink firing scheme.

In the thermal bubble jet type ink firing scheme, by electrically heating a chamber, ink which is stored in a chamber is fired through a nozzle by thermal expansion. In the piezo transducer type ink firing scheme, by driving a vibrating plate by a piezoelectric actuator, ink which is stored in a chamber is fired through a nozzle by vibrating force of the vibrating plate.

Because ink particles fired in these manners as described above have a size of several tens $\mu$m (about 40 $\mu$m) and a plurality of particles are fired simultaneously in many places, precise operability is required above all things.

FIG. 1 illustrates an embodiment of the piezo transducer type ink firing scheme which is widely used between the two ink firing schemes. In the piezo transducer type ink firing scheme, as a piezoelectric device, PZT is used.

In an ink jet printer head used in this piezo transducer type ink firing scheme, a nozzle plate 110, a reservoir plate 120, a restrictor plate 130, a chamber plate 140 and a vibrating plate 150 are sequentially laminated from bottom to top. A lower electrode 161, a piezoelectric element 163 and an upper electrode 162 are also sequentially laminated on the vibrating plate 150 thereby to constitute a piezoelectric actuator 160.

In the above construction, the nozzle plate 110 is formed at its one side with a nozzle 111 of a small diameter. The nozzle 111 defines a discharging hole through which ink is actually fired.

The reservoir plate 120 which is laminated on the nozzle plate 110 is formed at one side thereof with a through hole 122 which is communicated with the nozzle 111 of the nozzle plate 110 for introducing ink into the nozzle 111 and at the other side thereof with a reservoir 121 which stores a proper amount of ink.

The restrictor plate 130 which is laminated on the reservoir plate 120 is formed at one side thereof with a through hole 132 which is communicated with the through hole 122 which is formed in the reservoir plate 120 to define a fluid passage and at the other side thereof with a restrictor 131 of a small diameter such that the restrictor 131 is communicated with the reservoir 121 for allowing a predetermined amount of ink to flow therethrough.

The chamber plate 140 which is laminated on the restrictor plate 130 is formed with a chamber 141 which are simultaneously communicated with the restrictor 131 and the through hole 132 which are formed at both sides of the restrictor plate 130, respectively. Ink flows into the chamber 141 through the restrictor 131 and flows out of the chamber 141 through the through hole 132. The chamber plate 140 allows ink flowing out of the chamber 141 to be fired through the nozzle 111 of the nozzle plate 110 after flowing through the through hole 132 of the restrictor plate 130 and the through hole 122 of the reservoir plate 120.

On the other hand, the vibrating plate 150 which is laminated on the chamber plate 140 covers an upper end of the chamber 141 which is opened at an upper end of the chamber plate 140. The vibrating plate 150 enables ink flowed into the chamber 141 to flow out of the chamber 141 through the through hole 132 of the restrictor plate 130. In this connection, the vibrating plate 150 serves as an operating section which actually changes volume of the chamber 141 by its flexural deformation, thereby changing pressure in the chamber 141 to allow ink to flow.

Because the flexural deformation of the vibrating plate 150 cannot be naturally generated, the piezoelectric actuator 160 is provided on the vibrating plate 150 for rendering the flexural deformation of the vibrating plate 150.

As described above, the piezoelectric actuator 160 comprises the lower electrode 161, the upper electrode 162 and the piezoelectric element 163 intervened therebetween. The piezoelectric actuator 160 serves as driving means which generates deformation of the piezoelectric element 163 by intermittent control of electric power which is supplied from the outside to the piezoelectric element 163.

In other words, piezoelectric element 163 contracts and expands depending upon electric power supply between the upper electrode 162 and the lower electrode 161, and as this flexural deformation of the piezoelectric element 163 is transferred to the vibrating plate 150 as it is, the flexural deformation of the vibrating plate 150 is generated.

Accordingly, if the piezoelectric actuator 160 is electrically driven, as the flexural deformation of the vibrating plate 150 is generated, the volume within the chamber 141 of the chamber plate 140 is changed. If the volume expands, ink flows into the chamber 141 from the reservoir 121 through the restrictor 131, and if the volume contracts, ink flows out of the chamber 141 through the respective through holes 132 and 122 and the nozzle 111 of the nozzle plate 110.

On the other hand, as the conventional piezoelectric element is required to endure a high temperature (conventionally 800° C.–1200° C.) due to its manufactural peculiarity, the lower electrode 161 and the vibrating plate 150 which are provided below the piezoelectric element 163 must be made using heat resistant material (such as platinum, zirconium, etc.) which will not be deformed at a temperature higher than the above temperature. However, recently, as a method for manufacturing a piezoelectric element at a low temperature is disclosed in the art, it is possible to use various materials for making the vibrating plate 150.

However, because the vibrating plate 150 is flexurally deformed as actual operating means which functions to suck ink into the chamber 141 and discharge ink through the nozzle 111, there is caused a problem in that adherence between the vibrating plate 150 and the chamber plate 140 is likely to be deteriorated.

That is to say, in order to couple the chamber plate 140 to the vibrating plate 150, in the conventional structure in which the vibrating plate 150 and the chamber plate 140 are made of ceramic materials, the vibrating plate 150 in the form of paste is applied onto the manufactured chamber plate 140 and then baked. Also, alternatively, separately manufactured vibrating plate 150 and the chamber plate 140 can be bonded to each other by using adhesive.

Especially, as shown in FIG. 2, the coupling structure between the vibrating plate 150 and the chamber plate 140 can be obtained in such a manner that a non-metallic mold 200 is attached to the vibrating plate 150 to define a space which is to be the chamber 141, and after the chamber plate 140 is formed around the non-metallic mold 200 by electroforming, the non-metallic mold 200 is removed.

However, with this methods for coupling the vibrating plate 150 and the chamber plate 140 with each other by baking or bonding as described above, not only it is difficult to maintain sufficient mechanical rigidity between the vibrating plate 150 and the chamber plate 140 when the vibrating plate 150 is flexurally deformed, but also it is difficult to form the plurality of chambers 141 having a size of several hundred $\mu$m (about 200 $\mu$m) in the chamber plate 140 such that they have an interval (about 100 $\mu$m) between two adjoining chambers 141, which is less than the size of themselves. Specifically, since separate costly equipment is required in order to form the plurality of chambers 141, manufacturing cost of the printer head is increased.

Also, in the case that the plurality of chambers 141 are formed by electroforming as shown in FIG. 2, as a fine difference is induced depending upon particulars in attaching the non-metallic mold 200 to the vibrating plate 150, as can be readily seen from FIG. 3, it is difficult to keep constant a distance t1 from an outside edge of the chamber plate 140 to the chamber 141 and an interval t2 between two adjoining chambers 141. Especially, since there is a tendency that the distance t1 from the outside edge portion of the chamber plate 140 to the chamber 141 is larger than the interval t2 between two adjoining chambers 141, adhering strength between the chamber plate 140 and the restrictor plate 130 varies from article to article.

SUMMARY OF THE INVENTION

Accordingly, the present invention has been made in an effort to solve the problems occurring in the related art, and a primary object of the present invention is to enable a plurality of chambers to be defined in a chamber plate in an easier manner so that they are uniformly spaced apart one from another and have uniform size, by manufacturing a vibrating plate and a chamber plate by thin metal plates and by integrally forming a protective thin film between the vibrating plate and the chamber plate.

Another object of the present invention is to increase mechanical rigidity of a vibrating plate and at the same time, to ensure uniform operability of the vibrating plate, by forming the vibrating plate with metallic material which is the same as that used for forming a chamber plate.

Still another object of the present invention is to improve durability of a vibrating plate by preventing the vibrating plate from being oxidated by the fact that ink is kept from being brought into direct contact with the vibrating plate by a protective thin film having oxidation-resistant property.

In order to achieve the above objects, according to the present invention, a chamber plate and a vibrating plate which are made of thin metal plates are integrally coupled with a protective thin film which serves as an etching ceasing layer, and the chamber plate is formed with a plurality of chambers which have uniform size and interval, by being patterned by a photolithographic process and an etching process. At this time, the protective thin film intervened between the chamber plate and the vibrating plate serves as an etching ceasing layer as described above when the plurality of chambers are formed and functions to prevent the vibrating plate from being corroded due to its direct contact with ink when it is applied to an article, thereby to improve productivity and article performance.

BRIEF DESCRIPTION OF THE DRAWINGS

The above objects, and other features and advantages of the present invention will become more apparent after a reading of the following detailed description when taken in conjunction with the drawings, in which:

FIGS. 6 through 14 are cross-sectional views illustrating manufacturing processes of a first embodiment of the present invention, wherein, FIG. 6 illustrates a step of forming a vibrating plate on a substrate;

FIG. 7 illustrates a step of depositing a protective thin film onto the vibrating plate of FIG. 6;

FIG. 8 illustrates a step of depositing a chamber plate onto the protective thin film of FIG. 7;

FIG. 9 illustrates a step of forming a photoresist layer on the chamber plate of FIG. 8;

FIG. 10 illustrates a step of exposing the photoresist layer of FIG. 9;

FIG. 11 illustrates a step of removing an exposed portion of the photoresist layer of FIG. 10;

FIG. 12 illustrates a step of supplying etching solution through the exposed portion of the photoresist layer of FIG. 11;

FIG. 13 illustrates a step of forming a chamber by etching in FIG. 12;

FIG. 14 illustrates a step of removing the photoresist layer which is left on the chamber plate, after the chamber is formed in the step of FIG. 13;

FIGS. 16 through 18 are cross-sectional views illustrating manufacturing processes of a second embodiment of the present invention, wherein, FIG. 16 illustrates a step of forming a chamber plate on a substrate;

FIG. 17 illustrates a step of depositing a protective thin film onto the chamber plate of FIG. 16; and FIG. 18 illustrates a step of depositing a vibrating plate onto the protective thin film of FIG. 17.

DETAILED DESCRIPTION

Figure 1:
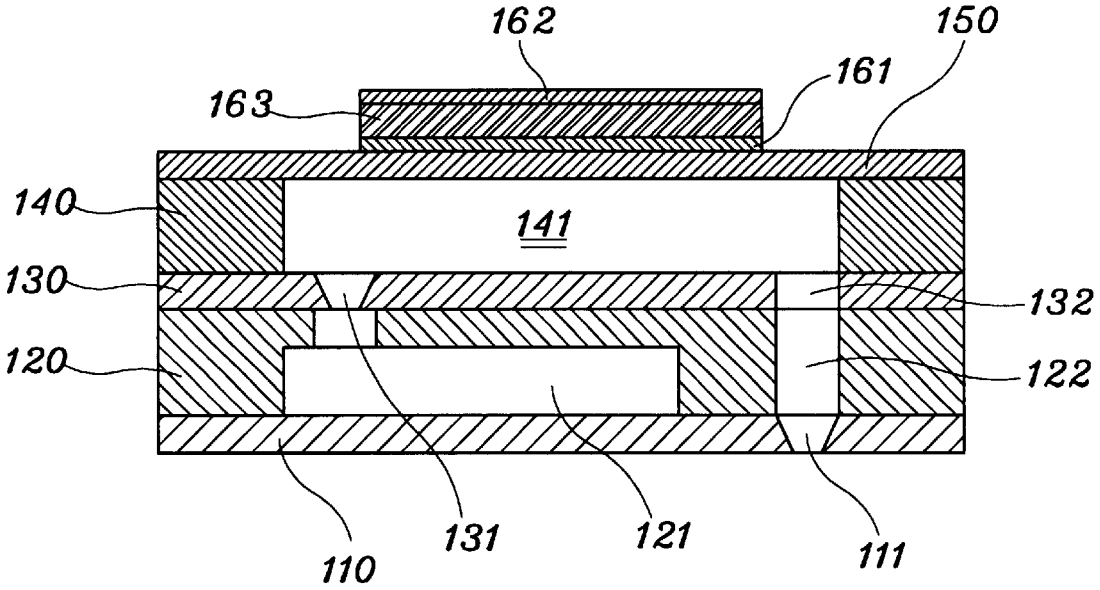
FIG.1 (CONVENTIONAL ART)
FIG. 1 is a cross-sectional view of an ink jet printer head according to the conventional art.
Figure 2:
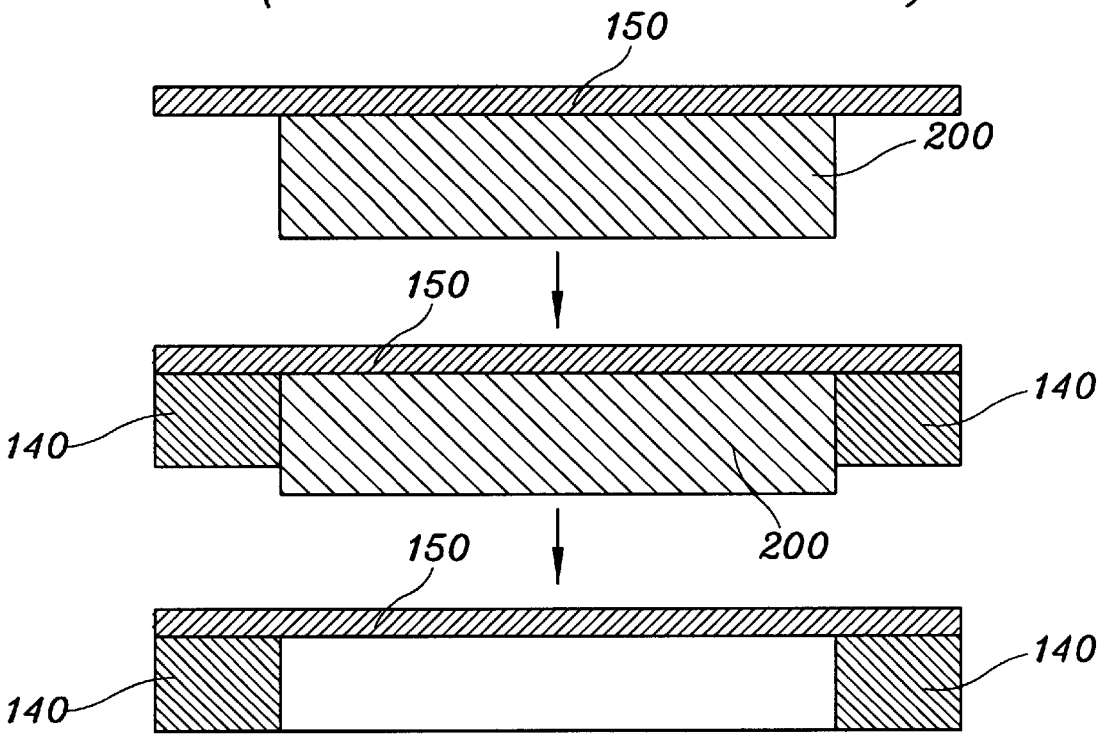
FIG.2 (CONVENTIONAL ART)
FIG. 2 is a flow diagram for explaining a coupling procedure between a chamber plate and a vibrating plate in the ink jet printer head of FIG. 1.
Figure 3:
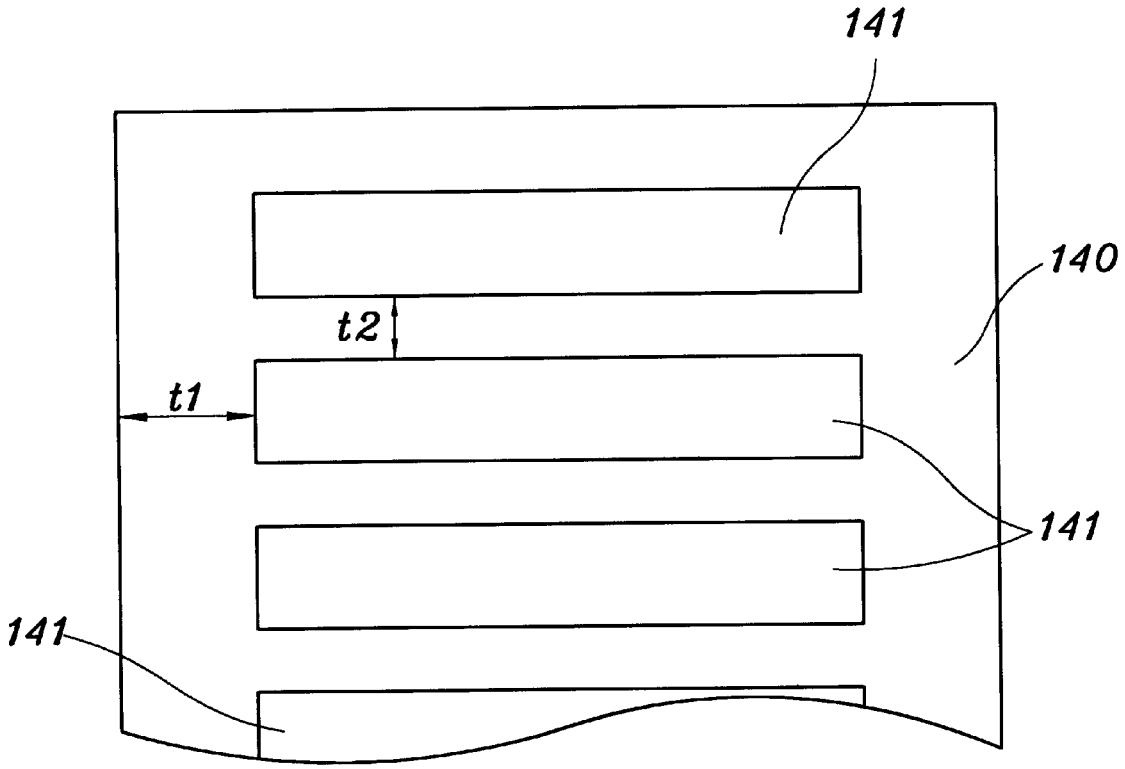
FIG. 3 (CONVENTIONAL ART)
FIG. 3 is a plan view of the chamber plate which is manufactured by the coupling procedure of FIG. 2.

Reference will now be made in greater detail to a preferred embodiment of the invention, an example of which is illustrated in the accompanying drawings. Wherever possible, the same reference numerals will be used throughout the drawings and the description to refer to the same or like parts.

Generally, a micro actuator in an ink jet printer head comprises a piezoelectric actuator, a vibrating plate which integrally operated by the piezoelectric actuator and a chamber plate which is coupled to the vibrating plate.

In a micro actuator according to the present invention, a vibrating plate in which a portion of a plate surface is mechanically deformed and a chamber plate which is formed to have a thickness larger than that of the vibrating plate are made of thin metal plates, and a protective thin film which has a fine thickness and serves as an etching ceasing layer is deposited between the vibrating plate and the chamber plate. By this, when performing an etching process for forming a plurality of chambers in the chamber plate, the plurality of chambers can be formed only in the chamber plate with aid of the etching ceasing function of the protective thin film.

Figure 4:
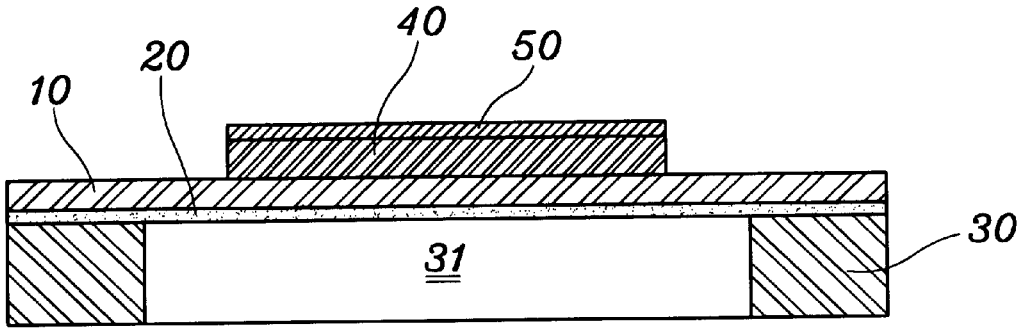
FIG. 4 is a cross-sectional view of an actuator of an ink jet printer head in accordance with an embodiment of the present invention.

In other words, in the present invention, as shown in FIG. 4, a vibrating plate 10 and a chamber plate 30 are made of thin metal plates, a protective thin film 20 which is made of noble metal and serves as an etching ceasing layer is deposited between the vibrating plate 10 and the chamber plate 30. A plurality of chambers 31 which suck and discharge in response to an operation of the vibrating plate 10, are formed in the chamber plate 30 by etching such that they have a desired configuration and a size. Above the plurality of chambers 31 of the chamber plate 30, a plurality of piezoelectric elements 40 which are deformed in a lengthwise direction by electric power supply thereto to vibrate the vibrating plate 10, are attached on the vibrating plate 10 such that they correspond to the plurality of chamber 31, respectively, and a plurality of electrodes 50 are laminated at least on the plurality of piezoelectric elements 40 for supplying electric power to the plurality of piezoelectric elements 40, respectively.

At this time, one of the vibrating plate 10 and the chamber plate 30 can be manufactured through a separate rolling or can be manufactured by electroforming such that is deposited on the other.

Figure 5:
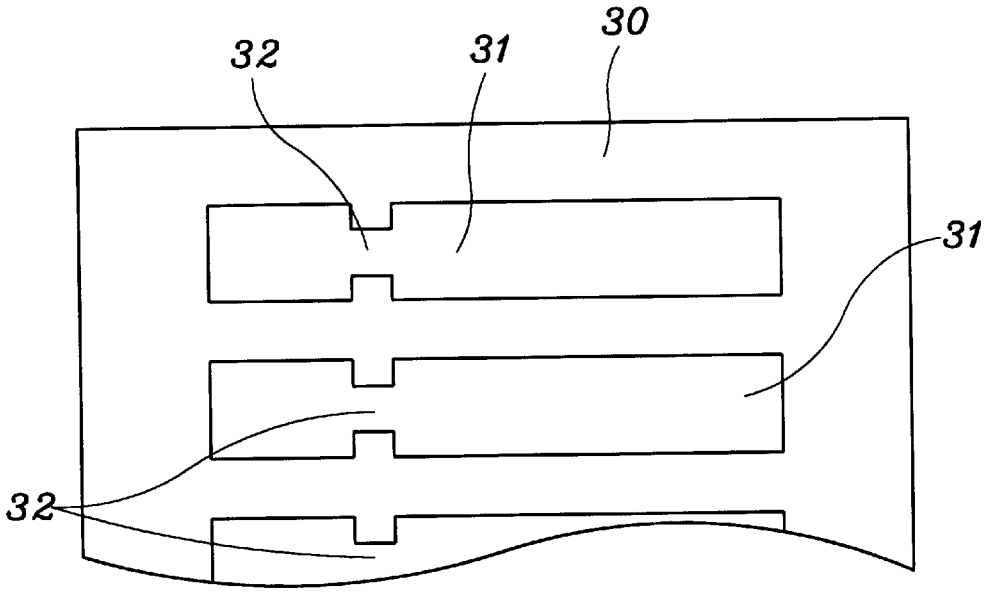
FIG. 5 is a plan view of a chamber plate of the ink jet printer head of FIG. 4.

In addition, while the plurality of chambers 31 are formed in the chamber plate 30 by etching such that they have a predetermined size and a predetermined interval between two adjoining chambers 31, specifically, each of the chambers 31 can be formed with a restrictor 32 which is narrowed in its width in a portion of the chamber 31 to adjust flowing velocity of ink, as shown in FIG. 5.

On the other hand, between the piezoelectric elements 40 and the electrodes 50 which are deposited onto the vibrating plate 10, while the electrodes 50 generally include both of upper electrodes and lower electrodes, in the present invention, since the vibrating plate 10 is made of conductive metal, when the vibrating plate 10 is used as a common electrode, lower electrodes can be omitted, and accordingly, only upper electrodes can be formed on the piezoelectric elements 40, respectively.

The micro actuator constructed as mentioned above is manufactured by a method as described below.

FIGS. 6 through 14 illustrate a method for manufacturing a micro actuator in accordance with a first embodiment of the present invention. First of all, a separate substrate 60 for manufacturing a multi-layered plate construction is prepared.

Figure 6:
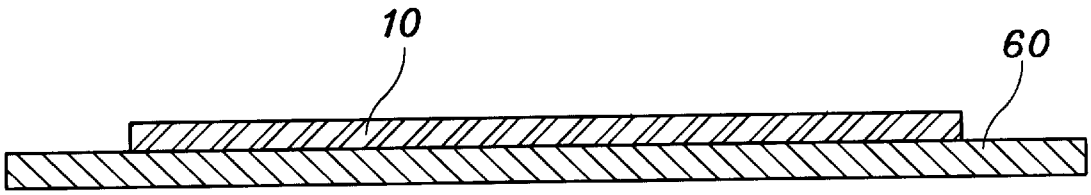
Figure 7:
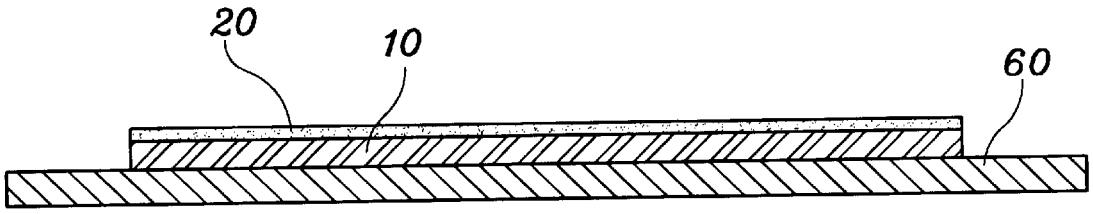
Figure 8:
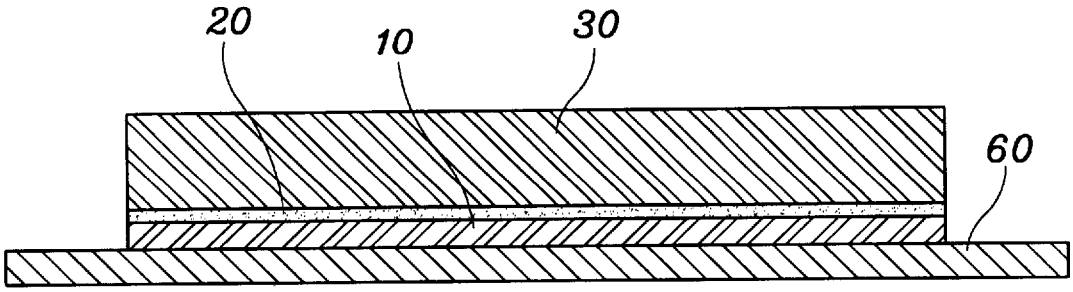
Figure 9:
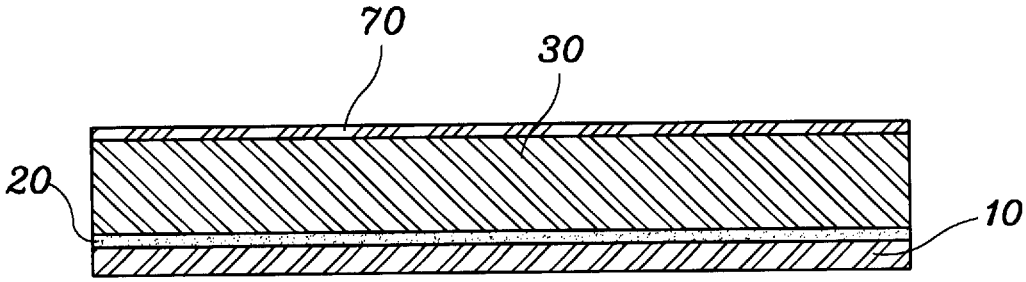

Then, the vibrating plate 10 is formed on the substrate 60 to have a predetermined thickness as shown in FIG. 6. At this time, the vibrating plate 10 can be formed of a metal plate which is manufactured by rolling separately from the substrate 60 and can be detachably coupled to the substrate 60. Alternatively, the vibrating plate 10 can be deposited onto the substrate 60 by electroforming. Also, in a further different way, the vibrating plate 10 can be formed on the substrate 60 by a vacuum vapor deposition technique such as sputtering or evaporation.

The vibrating plate 10 formed in this way has as its main constituents nickel (Ni), copper (Cu), chrome (Cr), tin (Sn), or iron (Fe). Among these, it is most preferred that the vibrating plate 10 has, as its main constituent, nickel (Ni).

It is also preferred that the vibrating plate 10 has a thickness of 3–50 $\mu$m.

The protective thin film 20 which is made of noble metal and serves as an etching ceasing layer, is deposited on the vibrating plate 10 which is formed on the substrate 60, such that it has a fine thickness. At this time, the protective thin film 20 is formed by vapor deposition using electroforming or by vacuum vapor deposition such as evaporation. While the protective thin film 20 can have its main constituents which are the same as those of the vibrating plate 10, it is preferred that the protective film 20 is made of noble metal material such as gold (Au), platinum (Pt) or palladium (Pd), or a stainless steel plate and has a thickness of 0.05–2 $\mu$m.

Further, the chamber plate 30 which is made of metal is deposited onto the protective thin film 20 such that it has a thickness which is larger than that of the vibrating plate 10. At this time, the chamber plate 30 is formed by electroforming or by vacuum vapor deposition such as sputtering or evaporation. The chamber plate 30 formed in this way has as its main constituents nickel (Ni), copper (Cu), chrome (Cr), tin (Sn), or iron (Fe), similarly as in the case of the vibrating plate 10. Among these, it is most preferred that the chamber plate 30 has as its main constituent nickel (Ni). It is also preferred that the chamber plate 30 has a thickness of 10–500 $\mu$m.

As described above, after the multi-layered plate is formed by sequentially laminating the vibrating plate 10, the protective thin film 20 and the chamber plate 30 on the substrate 60, the substrate 60 is detached from the multi-layered plate, and the plurality of chambers 31 are formed in the chamber plate 30 as shown in FIGS. 9 through 14.

Figure 10:
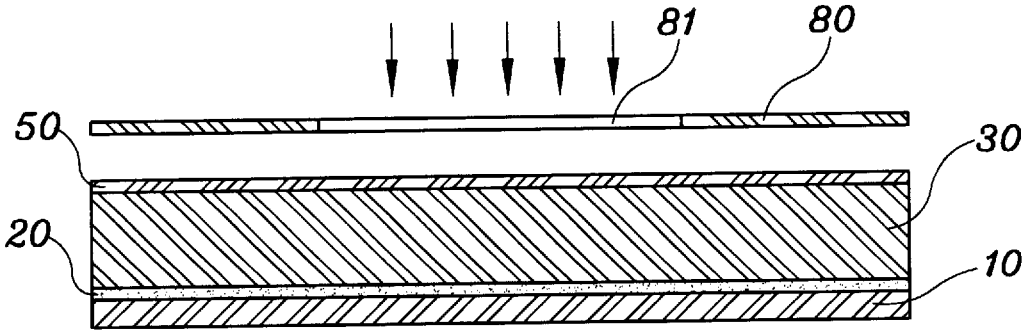

On one surface of the chamber plate 30 which is opposed to the other surface thereof onto which the protective layer 20 is deposited, there is applied photoresist solution to a constant thickness to define a photoresist layer 70. After soft baking the photoresist layer 70 for a predetermined time so as to cure it, exposing and developing operations are performed using a shadow mask 80 in which a plurality of holes 81 are formed such that they are spaced apart one from another, as shown in FIG. 10. By the fact that an exposed portion of the photoresist layer 70 is washed by using washing solution, an unnecessary portion of the photoresist layer 70 is removed.

Figure 15:
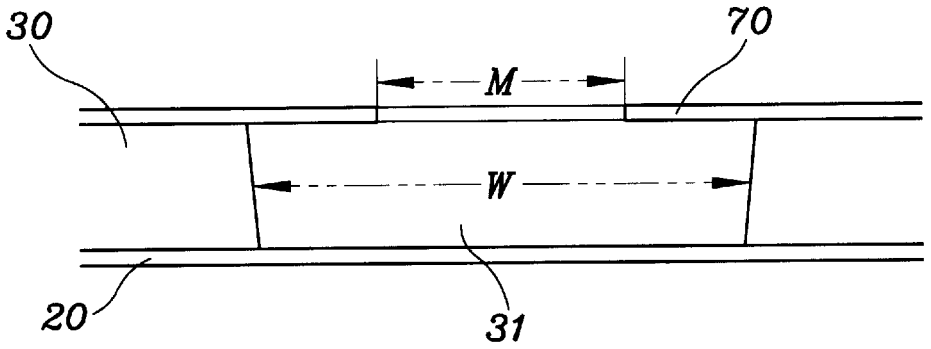
FIG. 15 is a schematic view illustrating a state wherein the photoresist layer is exposed.

It is most preferred that, when W is an area of each chamber 31 to be formed in the chamber plate 30, an area M of the exposed portion in the photoresist layer 70 which is exposed by the shadow mask 80 as described above, satisfies a formula $M < W$, as shown in FIG. 15.

Figure 11:
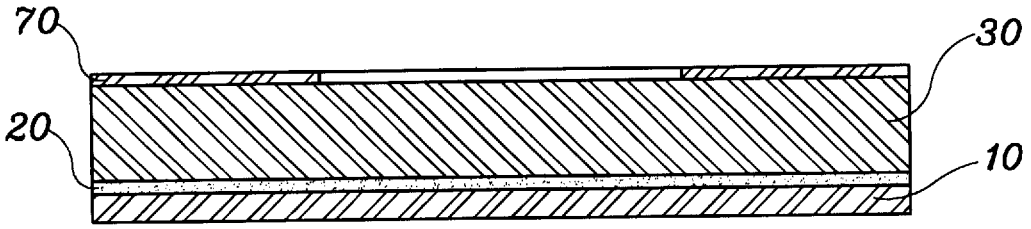
Figure 12:
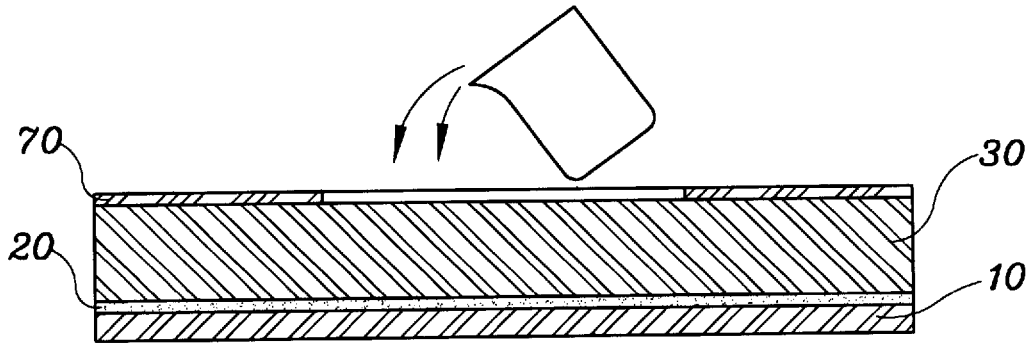

On the other hand, FIG. 11 illustrates a state wherein the exposed portion of the photoresist layer 70 is completely removed by the washing solution. In this state, hard baking is performed, and etching solution is supplied to a portion of the chamber plate 30 which is exposed through the removed portion of the photoresist layer 70, thereby to etch the chamber plate 30.

When etching the chamber plate 30, if the etching solution performing etching function passes through an entire thickness of the chamber plate 30 to reach the protective thin film 20, etching is ceased not to occur any more in the widthwise direction. After a predetermined time is lapsed in this state, side etching is automatically ceased to define the chamber 31 having a desired size.

Upon etching, by lengthening an actual etching time such that it is longer than the time over which the etching solution reaches the protective thin film 20, it is possible to obtain an angle of a side wall of the chamber 31 which approaches substantially to 90°.

Figure 13:
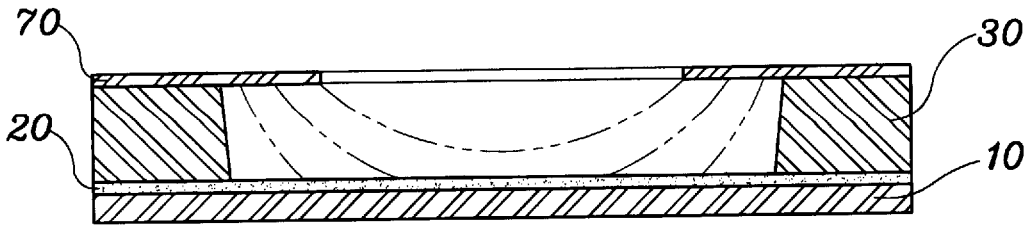
Figure 14:
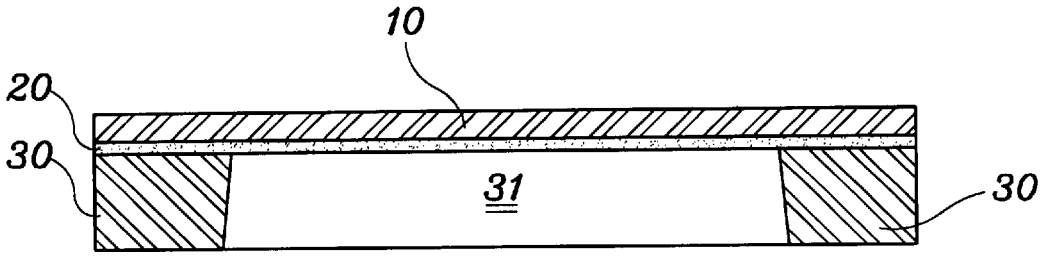

If the chamber 31 is formed by etching to have a configuration as shown in FIG. 13, by performing a stripping using a stripper, cross-sections of the etched chambers 31 can be at a standstill. Finally, by chemically removing the photoresist layer 70 which is left on the chamber plate 30, the multi-layered plate as shown in FIG. 14 can be obtained.

In the multi-layered plate, if the piezoelectric elements 40 and the electrodes 50 are formed on the vibrating plate 10, the desired ink jet printer head actuator can be obtained.

On the other hand, between the piezoelectric elements 40 and the electrodes 50 which are formed on the vibrating plate 10, the piezoelectric elements 40 are deposited onto the vibrating plate 10 by screen printing, molding or coating, as in the conventional art, and the electrodes 50 may be deposited onto the piezoelectric elements 40, respectively, by electroforming or vacuum vapor deposition.

Specifically, in the present embodiment, since the vibrating plate 10 is made of metal, electrodes which are divided into upper electrodes and lower electrodes can only include upper electrodes 50, and the vibrating plate 10 can be used as a common electrode.

As described above, by enabling the vibrating plate 10 and the chamber plate 30 to have their main constituents nickel (Ni), copper (Cu), chrome (Cr), tin (Sn), or iron (Fe), manufacturing operations can be easily performed.

Further, due to the fact that the protective thin film 20 is made of noble metal material such as gold (Au), platinum (Pt) or palladium (Pd), or a stainless steel plate, when the chamber plate 30 is etched, etching does not occur in other structural components except for the chamber plate 30, whereby it is possible to prevent the vibrating plate 10 from being corroded due to direct contact with ink when the micro actuator is applied to an article.

Figure 16:
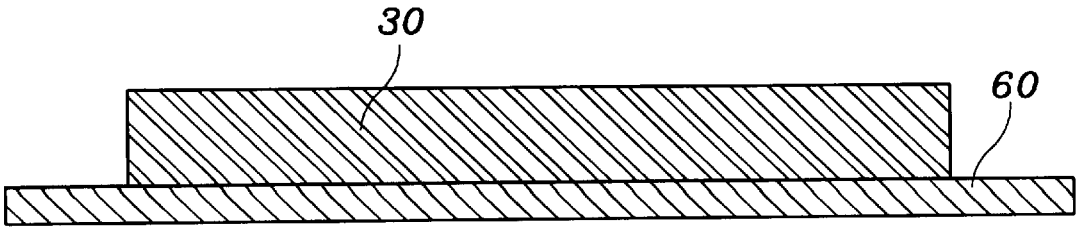
Figure 17:
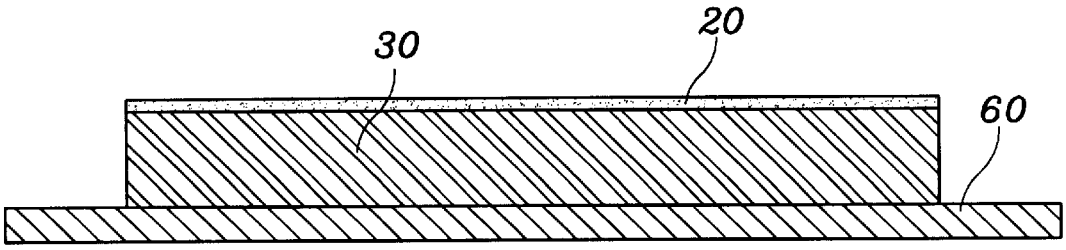
Figure 18:
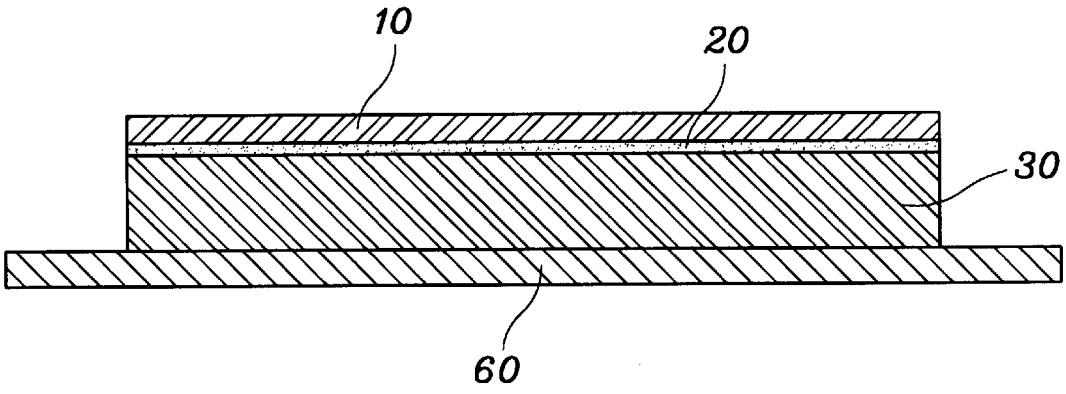

In the meanwhile, FIGS. 16 through 18 illustrate a second embodiment of the present invention. The present embodiment has its own characteristic in that a laminating sequence in a multi-layered plate is differentiated from that in the case of the first embodiment.

Namely, on the contrary that the vibrating plate 10 is initially formed on the substrate 60 in the fist embodiment, in the present embodiment, the chamber plate 30 is initially formed on the substrate 60.

At this time, the chamber plate 30 can be formed of a metal plate which is separately manufactured from the substrate 60 and can be detachably coupled to the substrate 60. Alternatively, the chamber plate 30 can be formed such that it is deposited onto the substrate 60 by electroforming. Also, in a further different way, the chamber plate 30 can be formed on the substrate 60 by a vacuum vapor deposition technique such as sputtering or evaporation.

The chamber plate 30 formed in this way has as its main constituents nickel (Ni), copper (Cu), chrome (Cr), tin (Sn), or iron (Fe). Among these, it is most preferred that the chamber plate 30 has as its main constituent nickel (Ni). It is also preferred that the chamber plate 30 has a thickness of 10–500 $\mu$m.

The protective thin film 20 which is made of noble metal and serves as an etching ceasing layer is deposited on the chamber plate 30 which is formed on the substrate 60, such that it has a fine thickness. At this time, the protective thin film 20 is formed by vapor deposition using electroforming or by vacuum vapor deposition such as evaporation. While the protective thin film 20 can have its main constituents nickel (Ni), copper (Cu), chrome (Cr), tin (Sn) or iron (Fe) which are the same as those of the chamber plate 30, it is preferred that the protective film 20 is made of noble metal material such as gold (Au), platinum (Pt) or palladium (Pd), or a stainless steel plate and has a thickness of 0.05–2 $\mu$m.

Further, the vibrating plate 10 which is made of metal is deposited onto the protective thin film 20. At this time, the vibrating plate 10 is formed by electroforming or by vacuum vapor deposition such as sputtering or evaporation. The vibrating plate 10 formed in this way has as its main constituents nickel (Ni), copper (Cu), chrome (Cr), tin (Sn), or iron (Fe), similarly as in the case of the chamber plate 30. Among these, it is most preferred that the vibrating plate 10 has as its main constituent nickel (Ni). It is also preferred that the vibrating plate 10 has a thickness of 3–50 $\mu$m.

As described above, after the multi-layered plate is formed by sequentially laminating the chamber plate 30, the protective thin film 20 and the vibrating plate 10 on the substrate 60, the substrate 60 is detached from the multi-layered plate, and the plurality of chambers 31 are formed in the chamber plate 30 in the same manner in the case of the first embodiment as shown in FIGS. 9 through 14.

In the multi-layered plate in which the plurality of chambers 31 are formed, if the piezoelectric elements 40 and the electrodes 50 are formed on the vibrating plate 10, the desired ink jet printer head actuator having a configuration as shown in FIG. 14 can be obtained. Of course, at this time, similarly as in the first embodiment, between the piezoelectric elements 40 and the electrodes 50 which are formed on the vibrating plate 10, the piezoelectric elements 40 are deposited onto the vibrating plate 10 by screen printing, molding or coating, and the electrodes 50 may be deposited onto the piezoelectric elements 40, respectively, by electroforming or vacuum vapor deposition.

As described above, in the present invention, since the vibrating plate 10 and the chamber plate 30 are made of thin metal plates, it is possible to manufacture the actuator with a desired minimum thickness.

Also, by the fact that each chamber 31 is formed by the etching process such that it is partially narrowed in its width, the restrictor 32 can be integrally and directly formed in the chamber plate 30, whereby a separate restrictor plate can be omitted thereby to reduce the number of components.

As a result of the omission of a separate restrictor plate, as described above, manufacturing cost of the printer head is reduced, the printer head can be miniaturized and a layout space can be enlarged.

Further, since the plurality of chambers 31 are formed by post-processing the chamber plate 31 using the photolithographic process and the etching process in a state wherein the vibrating plate 10, the protective thin film 20 and the chamber plate 30 are sequentially and integrally laminated one upon another, positional allowances between respective chambers 31 are almost removed, more uniform ink firing efficiency is accomplished, coupling force of the chamber plate 30 with another member, that is, adherence of the chamber plate 30 with the restrictor plate, the reservoir plate or the nozzle plate is uniformed thereby to achieve more firm adhering force.

In addition to this, since costly equipment such as a high precision penetrating machine which is otherwise needed in the conventional art, is not needed according to the present invention, manufacturing cost of the printer head can be remarkably reduced and mass production becomes possible.

Therefore, in the present invention, since a protective thin film made of noble metal is integrally formed between a vibrating plate and a chamber plate which are made of thin metal plates, mechanical rigidity of the vibrating plate is enhanced and formation of a plurality of chambers by post-processing is easily performed, whereby manufacturing cost including equipment cost and material cost is conspicuously reduced and at the same time, when an actuator is applied to an article, the vibrating plate is prevented from being corroded by ink thereby being elevated in durability.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. An ink jet printer head actuator comprising:

a vibrating plate being a thin metal plate, a portion of a plate surface of the vibrating plate being mechanically deformed by an external force;

a chamber plate having a thickness which is larger than that of the vibrating plate, a plurality of chambers being defined in a plate surface of the chamber plate by etching such that they are spaced apart one from another by a predetermined distance, the chamber plate being a thin metal plate which sucks and discharges ink into and out of the plurality of chambers by vibration of the vibrating plate; a protective thin film integrally intervened between the vibrating plate and the chamber plate so as to prevent the vibrating plate from being etched when the plurality of chambers are formed in the chamber plate and so as to prevent the vibrating plate from being corroded by keeping ink in the plurality of chambers from being brought into contact with the vibrating plate; a plurality of piezoelectric elements attached to a surface of the vibrating plate which is opposed to the plurality of chambers, for vibrating portions of the vibrating plate which correspond to the plurality of chambers, respectively, while being deformed in a lengthwise direction depending upon electric power supply; and a plurality of electrodes at least laminated on the plurality of piezoelectric elements for supplying electric power thereto, respectively.

2. An ink jet printer head actuator as claimed in claim 1, wherein each of the plurality of chambers is formed with a restrictor which is narrowed in width to adjust velocity of ink flowing through each chamber.

* * * * *